United States Patent [19]

Otani et al.

[11] 4,377,425

[45] Mar. 22, 1983

[54] CAST INGOT OF ALUMINUM ALLOY AVAILABLE FOR ROLLING OPERATION AND METHOD FOR MANUFACTURING THE SAME

[75] Inventors: Takeshi Otani, Yokohama; Osamu Watanabe, Minoo; Masashi Sakaguchi, Sakai, all of Japan

[73] Assignees: Showa Aluminum Ind. K.K., Minato; Showa Aluminum Corp., Sakai, both of Japan

[21] Appl. No.: 208,383

[22] Filed: Nov. 19, 1980

[30] Foreign Application Priority Data

Nov. 20, 1979 [JP] Japan ..... 54-150942

[51] Int. Cl.[3] ..... C22C 21/00

[52] U.S. Cl. ..... 148/437; 148/440; 420/543; 420/551; 420/552

[58] Field of Search ..... 75/138, 147; 148/32

[56] References Cited

U.S. PATENT DOCUMENTS 3,926,690 12/1975 Morris et al. ..... 148/32

*Primary Examiner*—R. Dean

*Attorney, Agent, or Firm*—Darby & Darby

[57] ABSTRACT

An improved cast ingot of aluminum alloy satisfactorily available for rolling operation containing Fe is disclosed which has no fir-tree structure or has only a very small region of fir-tree structure. This cast ingot of aluminum alloy contains calcium in the range of 0.0005 to 0.05% and has a grain size smaller than 150 microns in the region extended inward of a coarse cell phase on the surface area of the cast ingot, particularly in the vicinity of said coarse cell phase. The cast ingot is manufactured by way of the steps of addition of the above amount of calcium to molten aluminum alloy, supplementary addition of 0.005 to 0.1% Ti and 0.0001 to 0.02% B to the molten aluminum alloy and then continuous D.C. casting.

6 Claims, 1 Drawing Figure

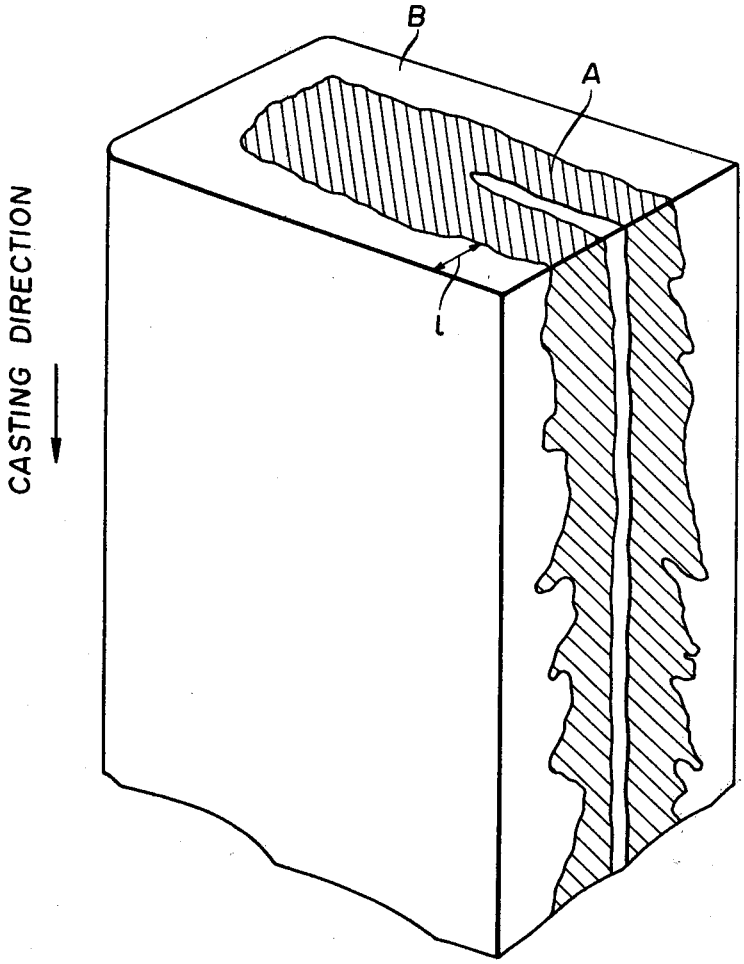
B
A
l
CASTING DIRECTION

CAST INGOT OF ALUMINUM ALLOY AVAILABLE FOR ROLLING OPERATION AND METHOD FOR MANUFACTURING THE SAME

BACKGROUND OF THE INVENTION

1. Field of the Invention

The present invention relates to a D.C. cast ingots of aluminum alloy available for rolling operation so that Al-Fe intermetallic compound is crystallized and moreover relates to a method of manufacturing said D.C. cast ingots.

2. Description of the Prior Art

Generally direct chill (D.C.) cast ingots of aluminum alloy containing Fe undergo the following processes. First their surface area is chipped off by a predetermined thickness (usually about 5–7 mm) so that a so-called coarse cell zone developed on the surface area of the respective D.C. cast ingots is removed. This coarse cell zone represents the zone where dendrite arm spacing in the D.C. cast ingots is large. Provided that it is rolled without any removal of the coarse cell zone, the result is that degraded rolled sheet or plate will be produced. Therefore the coarse cell zone should be removed prior to rolling operation. Then the cast ingots with the surface area thereof removed is subjected to rolling operation. Next the rolled product in the form of sheet or plate undergoes anodizing treatment. As far as the conventional D.C. cast ingots of aluminum alloy containing Fe is concerned, it has been sometimes recognized that the anodized product has a band-shaped pattern of a different colour on its outer surface.

It is well know that the aforesaid band-shaped pattern caused by anodizing is attributable to a so-called fir-tree structure which is occurence within the D.C. cast ingots.

In fact the term "fir-tree structure" designates a particular fire-tree shaped macro-structure which is developed in a D.C. cast ingots. Specifically, it is often recognized with the continuous D.C. cast ingot that when they are cut in the casting direction and then their exposed cut surface is subjected to anodizing, a dark or dark grey fir-tree shaped pattern developes on the cut surface as shown in FIGURE. This macro-structure having a fir-tree shaped pattern is referred to as fir-tree structure.

When the D.C. cast ingots with the fir-tree structure contained therein is rolled with its surface area chipped off in the above described manner, the sheet or plate produced by the rolling has a pattern comprising a fir-tree structure region (A) and a non-fir-tree structure region (B) which are alternately located. Next, when the rolled sheet or plate is subjected to anodizing treatment, its surface appears dark or dark grey over the region (A), while it appears light grey over the region (B). As a result the surface of the rolled sheet or plate shows the band-shaped pattern as described above.

Once any pattern developes over a surface of rolled sheet or plate which has been subjected to anodizing treatment, the sheet or plate is unavoidably rejected as a worthless product because of its unattractive appearance, resulting in substantially reduced productivity. Rejected sheet or plates are remelted to recover aluminum material in the form of D.C. cast ingot, but a part of remelted material is oxidized during a process of remelting, degassing and other treatment. It should be emphasized that aluminum alloy material usually has a remarkably high level of material loss due to oxidation.

In order to prevent any formation of band-shaped pattern on the rolled sheet or plate it is advisable that all D.C. cast ingots are sliced off in the transverse direction prior to rolling operation to check as to how the fir-tree structure developes in the respective D.C. cast ingots. This is intended to determine a thickness to be chipped off over the upper and lower surfaces of the respective D.C. cast ingots and moreover to ensure that either of a fir-tree structure area and a non-fir-tree structure area appears across the cut surface thereof. A problem is, however, that the above described procedure results in a substantially reduced productive efficiency.

In view of the background as described above, anxious requirements have been raised for remedial measures against development of the fir-tree strucutre in the D.C. cast ingots which has been considered as a fundamental cause of formation of bandshaped pattern.

D. Altenpol had been so stated on his previous report (Zeit. für Metallkde., 46 (1956), 536) that above mentioned "fir-tree structure" (he so called "Tannenbaumastes") is attributable to a segregation phenomenon on a process of solidification in the D.C. casting. However, later workers have been presented that said structure are due to a form of crystallized Al-Fe intermetallic compounds in the D.C. cast ingots. In practice, however, no satisfactory clarification has been reached on the phenomenon of development of the fir-tree structure. At present an acceptable presumption is that development of the fir-tree structure is attributed to the fact that Al-Fe intermetallic compounds having different characters are crystallized in different regions in a cast ingot. Specifically, $Al_6fe$ is crystallized in the fir-tree structure region (A), while $Al_3Fe$ and AlmFe is crystallized in the non-fir-tree structure region (B), wherein the preceding suffix m denotes the number which is neither 3 nor 6. It seems to that $Al_6Fe$ crystals are not dissolved in $H_2SO_4$ aqueous solution treatment so that the crystals are retained within the anodic oxide film and the existence of $Al_6Fe$ crystals causes the film to appear dark or dark grey. In the meanwhile, it is presumed that $Al_3Fe$ and AlmFe crystals are completely dissolved in $H_2SO_4$ aqueous solution without any residue in the film of anodic oxide film, which causes said anodic oxide film to appear light grey.

The aforesaid crystallization of Al-Fe intermetallic compound is dependent on the rate of solidification of molten metal (i.e. cooling rate). It has been experimentally confirmed that $Al_3Fe$ is crystallized when molten metal is solidified slowly, and $Al_6Fe$ is crystallized when it is solidified quickly, and AlmFe is crystallized when it is solidified more quickly.

This suggests that it is possible to reduce an area of region where $Al_6Fe$ is crystallized, that is, the region of fir-tree structure by way of the step that molten metal is solidified slowly. In other words, it is possible to increase the distance l showed in FIG. 1 from the surface of the D.C. cast ingot to the boundary of the fir-tree structure in a same manner. A problem is, however, that solidification slowly causes substantially reduced productive efficiency.

Another approach to eliminating of the fir-tree structure is to continuously heat treat cast ingots. $Al_6Fe$ crystals in the region (A) of the fir-tree structure has a metastable phase which is thermally instable. By heating it for a period longer than 4 hours at a temperature of 620° C. it is transformed into $Al_3Fe$ which has a stable phase. It has been recognized as drawbacks with this process that production efficiency is reduced and manufacturing installation is relatively expensive. As a result it's difficult for us to employ this process for actual production at present.

OBJECTS OF THE INVENTION

It is a principal object of the present invention to provide a D.C. cast ingot of aluminum alloy very suitable for rolling operation in which no fir-tree structure is existent, or even if any, fir-tree structure is existent only within a limited small region at the center of D.C. cast ingot.

Other objects and advantageous features of the invention will be apparent from the following description which has been prepared with reference to the accompanying single drawing.

SUMMARY OF THE INVENTION

A D.C. cast ingot of aluminum alloy containing Fe in accordance with the present invention is such that it further contains calcium in the range of 0.0005 to 0.05% and has a grain size smaller than 150 microns in the region extended inward of a coarse cell zone developed on the outer surface area of the D.C. cast ingot, particularly in the vicinity of said coarse cell zone. Owing to the multiplicative effect derived from the addition of adequate amount of calcium to the aluminum alloy as well as the grain refining as described above, no fir-tree structure is developed within the D.C. cast ingot and even if any, it is limited only in a very small region at the center of cast ingot. Thus no formation of bandshaped pattern is recognized on the anodized sheet or place surface of intended products which are obtained by way of the steps of chipping off the surface of a D.C. cast ingot by a predetermined thickness and subjecting the cut ingot to rolling and anodizing.

BRIEF DESCRIPTION OF THE ACCOMPANYING DRAWING

An accompanying single drawing is a schematic perspective view of a part of a D.C. cast ingot of aluminum alloy containing a fir-tree structure therein.

DETAILED DESCRIPTION OF THE INVENTION

Aluminum alloy contained as a main constituent in a D.C. cast ingot according to the present invention is preferably an aluminum alloy containing Fe more than 0.2% which is identified by AA 1000 series or AA 5000 series alloys in accordance with the Aluminum Association Standardization and relative high purity aluminum comprising more than 99.9% Al with approx. 0.03 to 0.07% Fe contained therein. In this connection it should be noted that the term "%" in this specification designates "weight percentage" by all means.

Further the D.C. cast ingot according to the present invention contains calcium in the range of 0.0005 to 0.05%. It has been recognized that either in case of less than 0.0005% Ca or in case of more than 0.05% Ca the present invention fails to attain its intended advantages because of the fact that the produced fir-tree structure developes a large area of region in the D.C. cast ingot. Preferably it contains calcium in the range of 0.001 to 0.01%.

Furthermore the D.C. cast ingot according to the present invention has a grain size smaller than 150 micron in the region extended inward of a coarse cell zone developed on the surface area of the D.C. cast ingot, particularly in the vicinity of said coarse cell zone.

Owing to the multiplicative effect brought about by the adequate content of calcium as well as definitive grain size in the D.C. cast ingot as described above, it has no fir-tree structure or has only a small limited area of fir-tree structure therein. This fact that the fir-tree structure is existent only within such a small limtied region means that the distance l between the boundary of the fir-tree structure and the outer surface of the D.C. cast ingot is substantially increased (see the accompanying drawing). Accordingly, there is seen no fir-tree structure in the region extending inward of the outer surface of the D.C. cast ingot by the distance l. When chipping off the surface of the D.C. cast ingot by a predetermined thickness (less than said distance l) to remove the coarse cell zone in accordance with the conventional chipping practices, the result is that it has a chipped surface free from any fir-tree structure. Thus it will be readily understood that no bandshaped pattern will appear on the surface of the sheet or place which is obtained by the steps of rolling and anodizing the above processed D.C. casting ingot.

Now typical steps of manufacturing a D.C. cast ingot according to the present invention will be described below.

First, calcium in the form of single element or in the form of Al-Ca or Al-Si-Ca alloy is added to the molten Al-Fe alloy. The amount of calcium is as defined above. Further titanium and boron in the form of their aluminum alloy such as Al-Ti-B alloy is added to the molten Al-Fe alloy. Preferably this Al-Ti-B alloy is prepared in the form of wire to be successively added to the molten metal while continuous D.C. casting is conducted. Addition of titanium and boron results in substantially grain refinning whereby the obtained D. C. cast ingot has a small limited grain size not larger than 150 microns in the region extended inward of the coarse cell zone, particularly in the vicinity of said coarse cell zone. It is preferable that the amount of addition of titanium is in the range of 0.0005 to 0.1%, whereas the same of boron is in the range of 0.0001 to 0.02%. This is because that in the case of less than 0.0005% Ti and less than 0.0001% B to be added it is considerably difficult to ensure a grain size smaller than 150 microns and on the other hand addition of more than 0.1% Ti and more than 0.02% B brings about problems of increased manufacturing cost and reduced its acceptability of anodizing treatment, moreover the effect of grain refinning of aluminum alloy is generally saturated at 0.1% Ti and 0.02% B.

Now the present invention will be further described with respect to the results of typical experiments.

Calcium was added to molten aluminum alloy which is identified by AA 1050, AA 1100 or AA 5005 and then Al-Ti-B alloy or Al-Ti alloy was added thereto in accordance with the conventional foundry practices which chroline gas was brown into the molten aluminum alloy for the purpose of degassing. Then the obtained molten aluminum alloy was subjected to continuous D.C. cating with the result that D.C. cast ingots having the dimensions of 400 mm thickness, 900 mm width and 2,000 mm length respectively were produced. It is to be noted that continuous D.C. casting was conducted under the conditions of 720° C. molten metal temperature at the outlet of a furnace and 75 mm/min. casting speed. Then test specimens in a form of thin plate were obtained from the resultant D.C. cast ingots by slicing them at the position located by the distance of 1,000 mm from the one end thereof, that is, at the central part of the D.C. cast ingots along a plane extending at a right angle to the longitudinal direction thereof. The test specimens were subjected to anodizing treatment in 15% $H_2SO_4$ aqueous solution.

Then the test specimens were observed as to whether or not the fir-tree structure does appear, and when the fire-tree structure appeared on the specimens, the distance from the periphery of the test specimen (corresponding to the outer surface of the D.C. cast ingot) to the boundary of the fir-tree structure (see the accompanying drawing) was measured.

Further the grain size in the region extended inward of the coarse cell zone on the outer surface of the cast ingot, particularly in the vicinity of said coarse cell zone was measured. The measurements of grain size were conducted at the plural positions located at an equal distance on two phantom lines which were spaced by 50 mm from the longer side ends of the test specimen (corresponding to the upper and lower surfaces of the cast ingot) respectively, said phantom lines extending in parallel to said longer sides. In practice five measurement positions were provided on the respective phantom lines and consequently the total number of measurement positions amounted to 10. The grain size measurements were conducted by observing the test specimen electrolytically etched in 1.8% $BHF_4$ aqueous solution with the aid of a polarizing microscope.

The results of the experiments with the above described test specimens are as shown in the following table.

| No. of specimen | Alloy indentification No. in accordance with AA | Method of grain refinning | Content of Ti and B as grain refiner (Wt. %) Ti | B | Grain size (μm) | Content of Ca (wt. %) | Fir-tree structure in D.C. cast ingot | Distance $\frac{1}{(mm)}$ | Remarks |
|---|---|---|---|---|---|---|---|---|---|
| 1 | 1050 | Method M1 | 0.01 | 0.002 | 130 | 0.0024 | no | — | cast ingot according |
| 2 | " | Method M2 | 0.005 | 0.001 | 113 | 0.0051 | " | — | to the invention |
| 3 | " | Method M3 | 0.01 | — | 160 | 0.0005 | Occurrence | 10 | the conventional cast |
| 4 | " | Method M1 | 0.01 | 0.002 | 130 | 0.0003 | " | 15 | ingot |
| 5 | " | Method M2 | 0.005 | 0.001 | 115 | 0.0615 | " | 20 | |
| 6 | 1100 | Method M1 | 0.01 | 0.002 | 125 | 0.0067 | no | — | cast ingot according |
| 7 | " | Method M2 | 0.005 | 0.001 | 110 | 0.0155 | " | — | to the invention |
| 8 | " | Method M2 | 0.005 | 0.001 | 108 | 0.0557 | Occurrence | 20 | the conventional cast |
| 9 | " | Method M3 | 0.01 | — | 155 | 0.0004 | " | 8 | ingot |
| 10 | " | Method M3 | 0.01 | — | 158 | 0.0048 | " | 65 | |
| 11 | 5005 | Method M1 | 0.01 | 0.002 | 133 | 0.0061 | no | — | cast ingot according |
| 12 | " | Method M2 | 0.005 | 0.001 | 111 | 0.0122 | " | — | to the invention |
| 13 | " | Method M1 | 0.01 | 0.002 | 132 | 0.0004 | Occurrence | 27 | the conventional cast |
| 14 | " | Method M2 | 0.005 | 0.001 | 112 | 0.0602 | " | 15 | ingot |
| 15 | " | Method M3 | 0.01 | — | 153 | 0.0006 | " | 20 | |

NOTE:
1. The Method M1 in the table designates a method in which a block of Al-5% Ti-1% B alloy is added in molten aluminum alloy in a holding furnace. This holding furnace is such that aluminum alloy molten in a melting furnace is reserved and maintained in the form of molten metal.
2. The Method M2 in the table designates a method in which a wire of Al-5% Ti-1% B alloy is added in molten aluminum alloy which passes through a casting trough. This casting trough serves for providing a channel through which molten metal is transferred from the aforesaid holding furnace to continuous D.C. casting molds.
3. The method M3 in the table designates a method in which a block of Al-5% Ti alloy is added to molten metal in a holding furnace.

As readily seen from the above table, no fir-tree structure is recognized with aluminum alloys which contain calcium in the range of 0.0005 to 0.05% and have a grain size smaller than 150 microns in the region extended inward of the coarse cell zone on the outer surface of the D.C. cast ingots. In the meanwhile, the conventional aluminum alloys have a fir-tree structure respectively, said fir-tree structure being spaced by a short distance from the outer surface of the D.C. cast ingots.

What is claimed is:

1. A direct chill cast ingot of an aluminum alloy selected from the group consisting of AA 1000 series and AA5000 series aluminum alloys, wherein said aluminum alloy comprises from about 0.0005 to about 0.05 weight percent calcium and has a grain size smaller than 150 microns in a region extending inward of a coarse cell zone on the surface area of the cast ingot, in the vicinity of said coarse cell zone said ingot being free of observable fir-tree structures on its outer surface and being suitable for rolling operations.

2. A cast ingot as described in claim 1, wherein said alloy comprises from about 0.001 to about 0.01 weight percent calcium.

3. A method of manufacturing a direct chill cast ingot of a molten aluminum alloy selected from the group consisting of AA1000 to AA5000 series aluminum alloys comprising the steps of adding to said molten alloy from about 0.0005 to about 0.05 weight percent calcium from about 0.0005 to about 0.1 weight percent Ti and from about 0.0001 to about 0.02 weight percent B and then continuously D.C. casting the molten alloy to form said ingot, said ingot having a grain size smaller than about 150 microns in a region extending inward of a coarse cell zone on the surface area of the cast ingot, in the vicinity of said coarse cell zone said ingot being free of observable fir-tree structures on its outer surface and being suitable for rolling operations.

4. A method according to claim 3 further comprising adding from about 0.001 to about 0.01 weight percent calcium to said molten alloy.

5. A method according to claim 4, further comprising adding elemental calcium to said molten aluminum alloy.

6. A method according to claim, 4 further comprising adding calcium in the form of Al-Ca or Al-Si-Ca to said molten aluminum alloy.

* * * * *